United States Patent [19]

Oesterling

[11] 4,003,277

[45] Jan. 18, 1977

BEST AVAILABLE COPY

[54] APPARATUS FOR MANIPULATING FILTER ROD SECTIONS OR THE LIKE

[75] Inventor: Erwin Oesterling, Hamburg, Germany

[73] Assignee: Hauni-Werke Korber & Co., KG, Hamburg, Germany

[22] Filed: Oct. 9, 1973

[21] Appl. No.: 404,604

[30] Foreign Application Priority Data

Oct. 13, 1972 Germany ..... 2250267

[52] U.S. Cl. ..... 83/102; 198/450

[51] Int. Cl.[2] ..... B26D 7/06; B65G 47/26

[58] Field of Search ..... 198/20 R, 20 C, 22 R, 198/25, 28, 32; 83/102

[56] References Cited

UNITED STATES PATENTS

| | | | |
|---|---|---|---|
| 3,036,581 | 5/1962 | Dearsley | 198/32 |
| 3,405,579 | 10/1968 | London | 198/32 |

FOREIGN PATENTS OR APPLICATIONS

| | | | |
|---|---|---|---|
| 770,173 | 3/1957 | United Kingdom | 198/20 C |

*Primary Examiner*—Blunk Evon C.
*Assistant Examiner*—Joseph E. Valenza
*Attorney, Agent, or Firm*—Peter K. Kontler; John Kurucz

[57] ABSTRACT

Apparatus for manipulating filter rod sections in a filter cigarette making machine has a magazine for filter rod sections of six times unit length and a drum-shaped first conveyor which is formed with axially parallel flutes receiving filter rod sections from the magazine and serving to transport the removed sections past two rotary cutters which subdivide each section into three coaxial filter plugs of two times unit length. The filter plugs are introduced into discrete flutes of three coaxial disks which form a staggering conveyor and wherein the flutes of each disk are staggered circumferentially with respect to the flutes of the other disks. The groups of filter plugs are removed from successive flutes of the first conveyor by the inclined edge faces of arcuate shrouds which extend along the path of movement of filter plugs in the flutes of the disks and are located downstream of the transfer station between the two conveyors. The means for introducing filter plugs into the flutes of the respective disks includes portions of surfaces flanking the flutes of the disks and/or the edge faces of additional shrouds which retain the filter rod sections and filter plugs in the flutes of the first conveyor during transport from the magazine to the transfer station. The filter plugs on the disks of the staggering conveyor are transferred into successive flutes of a further drum-shaped conveyor and are moved axially so that they form a single row wherein the filter plugs move sideways and each filter plug is located exactly behind the preceding filter plug. The distance between the axes of the first conveyor and staggering conveyor slightly exceeds the radius of the pitch circle of the first conveyor plus the radius of the pitch circle of the staggering conveyor, and the staggering conveyor is driven clockwise if the first conveyor rotates counterclockwise, or vice versa.

16 Claims, 2 Drawing Figures

APPARATUS FOR MANIPULATING FILTER ROD SECTIONS OR THE LIKE

BACKGROUND OF THE INVENTION

The present invention relates to apparatus for manipulating rod-shaped articles, especially for manipulating filter rod sections. More particularly, the invention relates to improvements in apparatus for converting groups of two or more coaxial rod-shaped articles which are moved sideways into a single row of rod-shaped articles which also move sideways and are located exactly or nearly exactly one behind the other. Such apparatus can be used in filter cigarette making or like machines wherein filter rod sections of multiple unit length are subdivided into shorter filter rod sections or plugs for introduction into the spaces between pairs of coaxial plain cigarettes to form therewith assemblies of three rod-shaped articles each. Such assemblies can be converted into filter cigarettes of double unit length by convoluting an adhesive-coated uniting band around each shorter filter rod section and the adjacent end portions of the respective plain cigarettes. As a rule, the filter rod sections of multiple unit length are withdrawn from a magazine or hopper by a fluted conveyor and are transported past one or more knives which subdivide each filter rod section into a group of two or more coaxial filter plugs. Such groups must be converted into a single row wherein the filter plugs are located one behind the other and wherein the filter plugs preferably move sideways for convenient introduction into the spaces between successive pairs of coaxial plain cigarettes of unit length.

German Pat. No. 1,272,795 discloses an apparatus wherein a first drum-shaped conveyor removes filter rod sections from the magazine and a rotary second or staggering conveyor converts the groups of coaxial filter plugs into a single row of filter plugs wherein successive filter plugs are located one behind the other, as considered in the direction of movement of the staggering conveyor. The two conveyors are driven to rotate in opposite directions and the pitch circle of the first conveyor is intersected by the pitch circle of the second conveyor. The second conveyor comprises several wheel- or disk-shaped portions which are adjacent to each other and each of which can accept one filter plug of a group of two or more coaxial filter plugs in a peripheral flute of the first conveyor. The disk-shaped sections are eccentric with respect to each other and their pitch circles have a common tangent at a transfer station where the filter plugs leave the second conveyor. The distance between the flutes of the disk-shaped sections at a second transfer station where the second conveyor receives filter plugs from the first conveyor equals $t/n$ wherein $t$ is the distance between neighboring flutes of the first conveyor and $n$ is the number of filter plugs in a flute of the first conveyor. The intersecting portions of the pitch circles of the two conveyors are substantially normal to each other; consequently, each filter plug must abruptly change the direction of its movement through 90° during transfer from a flute of the first conveyor into a flute of a disk-shaped section of the second conveyor. The stresses to which the filter plugs are subjected during such abrupt transfer in a high-speed filter cigarette making machine can be withstood reasonably well by filter plugs containing exclusively acetate fibers but such stresses often result in damage to so-called combination filter plugs which contain granular and/or pulverulent filter material as well as to filter plugs containing acetate fibers together with pulverulent carbon or other solid material in finely comminuted form.

Another drawback of the just described apparatus is that it comprises a large number of complex precision-finished and hence expensive parts. This is due to the fact that the disk-shaped sections of the staggering conveyor are eccentric with respect to each other and must be provided with precision-finished internal gears receiving torque from discrete pinions which, in turn, receive motion from a complex transmission. The aforementioned German patent does not disclose the exact details of drive means for the sections of the staggering conveyor; in actual practice, the drive means for the two conveyors constitutes the most expensive, sensitive and complex portion of the apparatus.

SUMMARY OF THE INVENTION

An object of the invention is to provide a novel and improved apparatus which can convert a row of groups of coaxial rod-shaped articles into a row of discrete rod-shaped articles without damaging and/or deforming the articles and at the rate which is required in a high-speed machine for the processing of such articles, especially in a filter cigarette making machine.

Another object of the invention is to provide an apparatus wherein the means for converting a row consisting of successive groups of coaxial articles into a single row of discrete rod-shaped articles is simpler, less expensive, more rugged and more reliable than the converting means of conventional apparatus.

A further object of the invention is to provide a novel and improved staggering conveyor for conversion of successive groups of coaxial rod-shaped articles into a single row of discrete rod-shaped articles.

An additional object of the invention is to provide novel and improved means for transferring groups of coaxial rod-shaped articles to the aforementioned staggering conveyor without damaging and/or defacing the articles even if such articles contain granular and/or pulverulent material and relatively thin and weak wrappers.

Still another object of the invention is to provide an apparatus which can be installed in existing filter cigarette machines as a superior substitute for conventional apparatus which serve to convert a single row of relatively long filter rod sections into a single row of relatively short filter rod sections while the long and short filter rod sections travel sideways.

The invention is embodied in an apparatus for manipulating filter rod sections or analogous rod-shaped articles which comprises a first conveyor (preferably a rotary drum) having a plurality of first receiving means which may constitute axially parallel peripheral flutes and each of which is arranged to transport sideways a group of $n$ (e.g., three) coaxial rod-shaped articles along a first substantially circular path having a portion extending along a transfer station, a second conveyor having $n$ annuli of second receiving means each of which is arranged to receive and transport sideways a single rod-shaped article along a second substantially circular path extending along the transfer station, the distance between the pitch circles of the two conveyors exceeding the sum of radii of the two pitch circles (for example, by a distance equal to or approximating the diameter of rod-shaped article) and the receiving means of the annuli of second receiving means being staggered with respect to each other as considered in the circumferential direction of the second conveyor, drive means for moving the two conveyors in opposite directions whereby the speed of the second conveyor preferably equals *n*-times the speed of the first conveyor, means for removing groups of rod-shaped articles from successive first receiving means at the transfer station, and means for introducing each article of a thus removed group of rod-shaped articles into a second receiving means of a different annulus of second receiving means.

The means for removing groups of rod-shaped articles from successive first receiving means may form part of stationary guide means (e.g., one or more arcuate shrouds) which extend along the second path downstream of the transfer station and serve to retain rod-shaped articles in the respective second receiving means.

The means for introducing each article of a group into a second receiving means belonging to a different annulus of second receiving means may include portions of the second conveyor and/or one or more portions of a second guide means which extends along the first path upstream of the transfer station and serves to retain groups of coaxial rod-shaped articles in the first receiving means. The means for removing may be designed to introduce successive groups of rod-shaped articles into a channel which is disposed at the transfer station and is defined by the first and second guide means.

The second conveyor may comprise several coaxial disks each of which is provided with a discrete annulus of second receiving means. Such second receiving means may constitute axially parallel peripheral flutes and each disk of the second conveyor may resemble a milling cutter.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
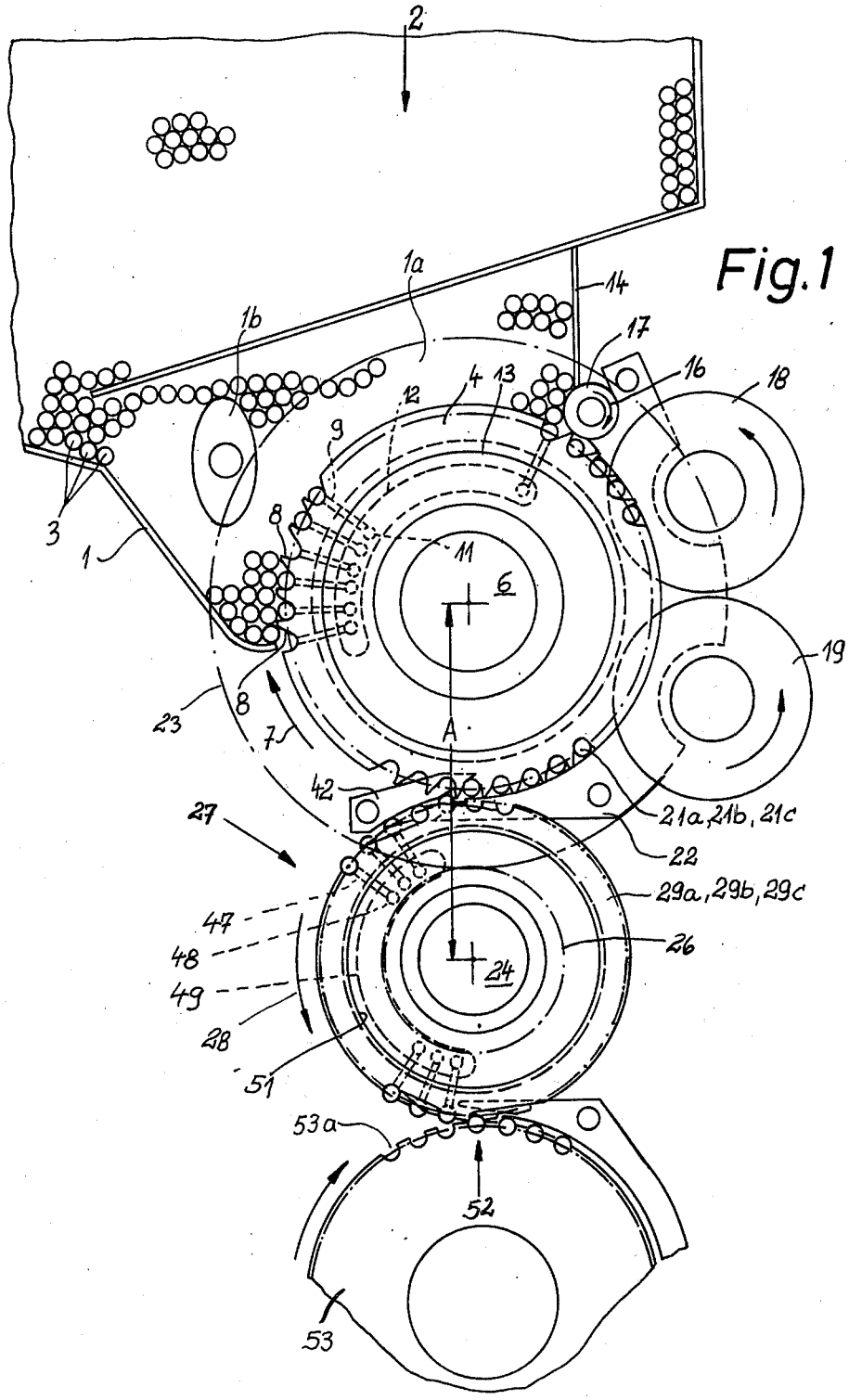
FIG. 1 is a schematic elevational view of an apparatus which embodies the invention.

Referring first to FIG. 1, there is shown a manipulating apparatus which forms part of a filter cigarette making machine including a magazine or hopper 1 containing a supply 2 of filter rod sections 3 of six times unit length. The magazine 1 has an arcuate outlet 1*a* at its lower end and contains one or more rotary or oscillatory agitators 1*b* which insure that the filter rod sections 3 descend toward the outlet 1*a*. The outlet 1*a* is partially closed by a portion of a rotary drum-shaped conveyor 4 which is driven to rotate in a direction indicated by arrow 7. The means for driving the conveyor 4 includes a horizontal shaft 6. The periphery of the conveyor 4 is provided with axially parallel receiving means in the form of flutes 8 each of which can receive a filter rod section 3 to transport such section along an endless circular path toward and past a vertical wall 14 of the magazine 1. The wall 14 is located at the right-hand end of the outlet 1*a*, as viewed in FIG. 1. The conveyor 4 is further provided with pneumatic means for holding or retaining the sections 3 in the flutes 8 during transport along the outlet 1*a* of the magazine 1. Such retaining means comprises radially inwardly extending suction ports 9 which are machined into the conveyor 4 and the outer ends of which communicate with the flutes 8. The conveyor 4 may be provided with one or more suction ports 9 for each flute 8. The inner end portions of the ports 9 communicate with axially parallel blind bores 11 each of which has an open end adjacent to one end face of the conveyor 4. This end face of the conveyor 4 is adjacent to a stationary valve plate 13 having at its inner side an arcuate groove 12 which extends along the outlet 1a and communicates with the adjacent blind bores 11 so as to attract the filter rod sections 3 into the respective flutes 8. The manner in which the groove 12 of the valve plate 13 is connected to a suction generating device (such as a blower, not shown) is well known from the art of filter cigarette making machines.

The apparatus further comprises a refuser in the form of a roller 17 which is located at a level below the vertical wall 14 of the magazine 1 and serves to prevent filter rod sections 3 from escaping by way of the outlet 1*a*. As shown, the roller 17 does not interfere with the evacuation of those filter rod sections which have entered the flutes 8 during travel of such flutes along the outlet 1*a*. The roller 17 is preferably provided with a smooth and hard peripheral surface so as to reduce the likelihood of damage to the filter rod sections 3. The direction in which the refuser roller 17 is driven by the prime mover of the filter cigarette making machine is indicated by arrow 16.

The conveyor 4 cooperates with a severing means including two rotary disk-shaped knives 18 and 19 which are mounted downstream of the refuser roller 17 and are rotated in directions indicated by arrows. The knives 18, 19 are staggered with respect to each other, as considered in the axial direction of the conveyor 4, and serve to subdivide each filter rod section 3 into a group of three coaxial filter rod sections or plugs 21*a*, 21*b*, 21*c* of two times unit length. Thus, when a flute 8 advances beyond the knife 19, it contains a group of three coaxial filter rod sections or plugs 21, 21*b*, 21*c*. The means for retaining the filter rod sections 3, 21*a*, 21*b*, 21*c* in flutes 8 during transposrt toward, past and beyond the knives 18 and 19 comprises several arcuate guide members or shrouds 22 of which only one is shown in FIG. 1.

Figure 2:
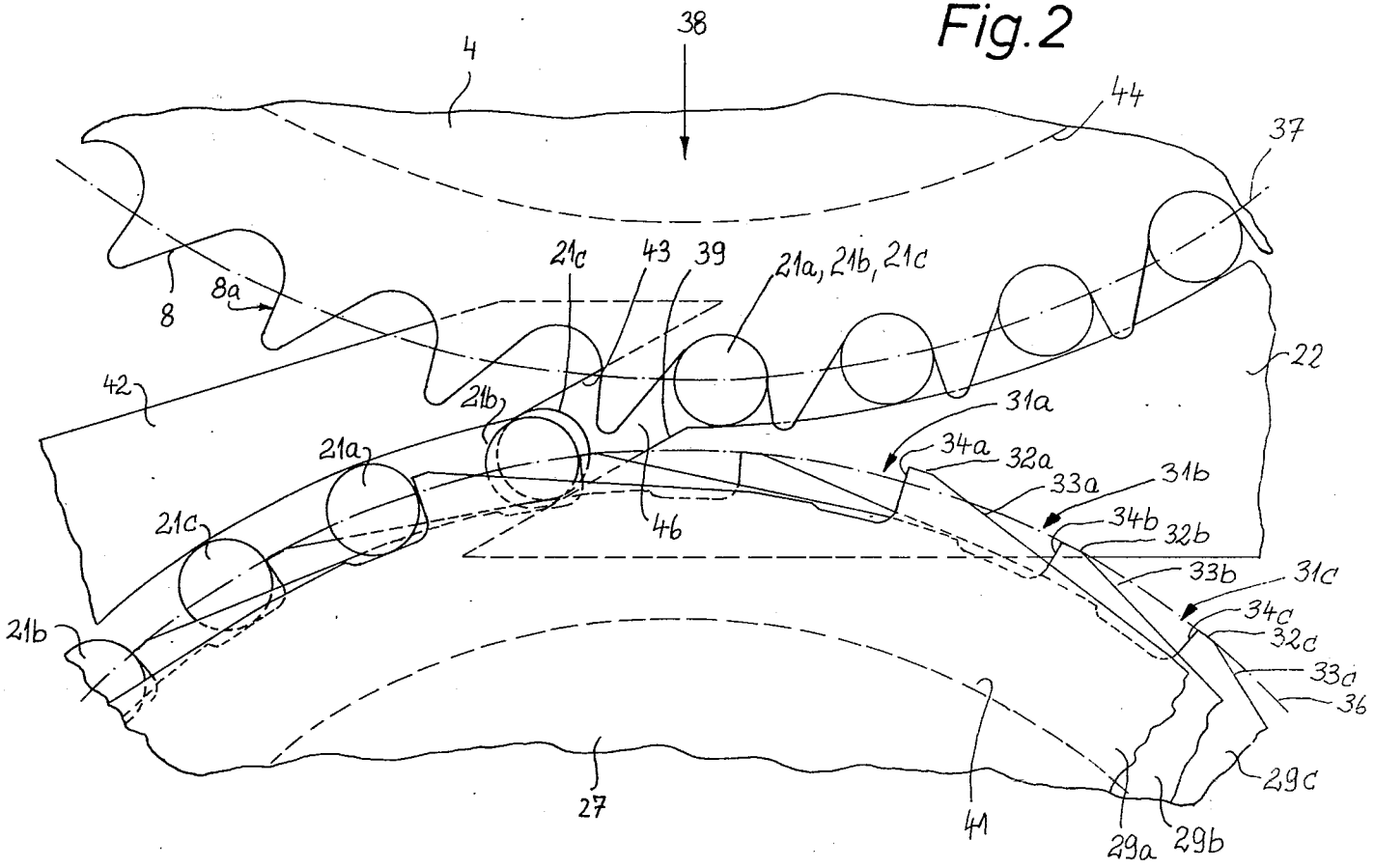
FIG. 2 is an enlarged view of a detail in the apparatus of FIG. 1.

The flutes 8 which advance beyond the knife 19 transport groups of coaxial filter plugs 21*a*, 21*b*, 21*c* to a transfer station 38 which is shown in FIG. 2 and at which the filter plugs are transferred into flutes provided in the disk-shaped portions or sections 29*a*, 29*b*, 29*c* of a staggering conveyor 27. The conveyor 27 is rotatable about the axis of a horizontal shaft 24 which is parallel to the shaft 6. The means for rotating the disks 29*a*, 29*b*, 29*c* in the direction indicated by arrow 28 comprises a first gear 23 which is coaxial with the shaft 6 and a smaller second gear 26 which is in mesh with the gear 23 and is coaxial with the shaft 24. For the sake of clarity, FIG. 1 merely shows the pitch circles of the gears 23 and 26. The distance A between the axes of the shafts 6 and 24 slightly exceeds the combined length of a radius of the pitch circle 37 of the conveyor 4 and a radius of the pitch circle 36 of the conveyor 27. It will be noted that the conveyors 4 and 27 rotate in opposite directions.

The disks 29*a*, 29*b*, 29*c* of the conveyor 27 are coaxial with each other and rotate as a unit. These disks are respectively provided with axially parallel peripheral receiving means or flutes 31*a*, 31*b*, 31*c* which are best shown in FIG. 2. Each of the disks 29*a*, 29*b*, 29*c* resembles a milling cutter. The surfaces 32*a*, 32*b*, 32*c* which respectively surround the flutes 31*a*, 31*b*, 31*c* comprise gradually sloping flanks 33*a*, 33*b*, 33*c* and steep (substantially radially extending) flanks 34*a*, 34*b*, 34*c*. The gradually sloping flanks 33*a*, 33*b*, 33*c* are located ahead of the respective steep flanks 34*a*, 34*b*, 34*c*, as considered in the direction of rotation of the staggering conveyor 27. It will be noted that the flutes 31*a*, 31*b*, 31*c* are staggered with respect to each other, as considered in the circumferential direction of the conveyor 27.

The flutes 31*a* (and particularly the steep flanks 34*a* of surfaces bounding the flutes 31*a*) extend radially outwardly beyond the pitch circle 36. On the other hand, the flutes 31*b* and 31*c* terminate at the pitch circle 36. The distance between the pitch circles 36 and 37 at the transfer station 38 need not appreciably exceed and may be less than the diameter of a filter plug 21*a*, 21*b*, or 21*c*.

The transmission ratio of the gear train 23, 26 is such that the conveyor 4 rotates through an angle corresponding to the distance between the centers of two neighboring flutes 8 while the conveyor 27 rotates through a much greater angle corresponding to the distance between two neighboring flutes 31*a*, 31*b*, or 31*c*. At the transfer station 38, the shrouds 22 are provided with inclined edge faces 39 along which successive groups of filter plugs 21*a*, 21*b*, 21*c* can travel to leave the respective flutes 8 and to move toward the staggering conveyor 27. Those end portions of the shrouds 22 which are provided with the edge faces 39 extend into ring-shaped grooves or recesses 41 of the staggering conveyor 27. Additional stationary guide members or shrouds 42 are provided adjacent to the staggering conveyor 27 downstream of the transfer station 38 to retain the filter plugs 21*a*, 21*b*, 21*c* in the respective flutes 31*a*, 31*b*, 31*c* during transport of such filter plugs toward a further transfer station 52 shown in FIG. 1. Each of the shrouds 42 has a sloping edge face 43 which is adjacent to the transfer station 38 and defines with the adjacent edge face 39 a channel 46 which is just wide enough to allow the plugs 21*a*, 21*b*, 21*c* to travel from the flutes 8 toward the flutes 31*a*, 31*b*, 31*c* of the disks 29*a*, 29*b*, 29*c*. Those portions of the shrouds 42 which are provided with edge faces 43 extend into ring-shaped recesses or grooves 44 of the conveyor 4. The width of the channels 46 at the transfer station 38 need not appreciably exceed the diameter of a filter plug. The edge faces 43 can be said to constitute a means for directing groups of filter plugs 21*a*, 21*b*, 21*c* from successive flutes 8 of the conveyor 4 into the channel 46. The flanks 33 or 34 of the disks 29 can be said to form part of means for introducing the filter plugs into the respective flutes of the staggering conveyor 27. Each of the disks 29*a*, 29*b*, 29*c* is provided with pneumatic retaining means for temporarily holding the filter plugs in the respective flutes 31*a*, 31*b*, 31*c*. Such retaining means comprises radially extending suction ports 47 shown in FIG. 1 axially parallel blind bores 48 in the conveyor 27, a stationary valve plate 51 which is adjacent to one end face of the conveyor 27, and an arcuate groove 49 which is machined into one face of the valve plate 51 and communicates with those suction ports 47 which travel from the transfer station 38 toward the transfer station 52. The groove 49 of the valve plate 51 can be connected to that suction generating device which evacuates air from the groove 12 of the valve plate 13.

At the transfer station 52, the flutes 31*a*, 31*b*, 31*c* deliver filter plugs into successive flutes 53*a* of a shuffling conveyor 53 which rotates in the direction indicated by arrow and transports a single row of axially staggered plugs past one or more suitable cams (not shown) which serve to place each filter plug into exact alignment with the adjacent plugs so that the plugs advancing beyond the cam or cams form a row wherein the two end faces of each filter plug are located in two predetermined planes. The shuffling conveyor 53 can transfer successive plugs into gaps between successive pairs of plain cigarettes of unit length which are transported by the flutes of an assembly conveyor. The thus obtained assemblies of coaxial rod-shaped articles (each such assembly comprises two plain cigarettes of unit length and a filter rod section or plug of double unit length therebetween) are ready to be provided with adhesive-coated uniting bands which are to be convoluted around the filter plugs and the adjacent end portions of plain cigarettes to convert each such assembly into a filter cigarette of double unit length in a manner not forming part of the present invention.

The guide means including the shrouds 22 and 42 can be said to constitute an arrangement which couples the conveyor 4 with the staggering conveyor 27. The edge faces 43 (which extend across the pitch circle 37) can be said to constitute a means for removing groups of filter plugs 21*a*–21*c* from successive flutes 8. The means for introducing filter plugs 21*a*, 21*b*, 21*c* into the flutes 31*a*, 31*b*, 31*c* of the respective annuli of flutes includes the edge faces 39 of the shrouds 22 (for the filter plugs 21*b*) and portions of the staggering conveyor 27, i.e., flanks 34*a* and 33*c* (for the filter plugs 21*a* and 21*c*). The edge faces 43 introduce the groups of filter plugs into the channel or channels 46.

The operation:

When the filter cigarette making machine is in use, the magazine 1 contains a supply 2 of parallel filter rod sections 3 of six times unit length. The agitator or agitators 1*b* insure that the sections 3 descend toward the outlet 1*a* so that each flute 8 which is located between the left-hand and right-hand ends of the outlet 1*a* receives a filter rod section 3. The refuser roller 17 prevents evacuation of filter rod sections 3 which are not received in the flutes 8, and the filter rod sections 3 which are received in such flutes advance past the severing means including the knives 18, 19 to be subdivided into groups each of which contains three coaxial filter rod sections or plugs 21*a*, 21*b*, 21*c* of double unit length. Suction in the ports 9 which communicate with the groove 12 of the valve plate 13 promotes the entry of filter rod sections 3 into those flutes 8 which travel past the outlet 1*a* of the magazine 1. The filter rod sections 3 and the filter plugs 21 which advance from the refuser roller 17 toward the transfer station 38 are held in the respective flutes 8 by the stationary shrouds 22.

When a group of coaxial filter plugs 21*a*, 21*b*, 21*c* reaches the transfer station 38, such filter plugs enter the range of edge faces 43 on the stationary shrouds 42 and are compelled to advance along the adge faces 39 of the respective shrouds 22 so as to move in the channels 46 sideways and toward the respective disks 29*a*, 29*b*, 29*c* of the staggering conveyor 27. The entry of successive groups of plugs 21*a*, 21*b*, 21*c* into the channels 46 is assisted by the substantially radially extending flanks 8*a* of surfaces bounding the respective flutes 8. Since the RPM of the staggering conveyor 27 is three times the RPM of the conveyor 4, the filter plug 21*a* of a group at the transfer station 38 is engaged by the steep flank 34*a* of the adjacent flute 31*a* and is transferred into such flute to travel along the concave inner surface of the respective shroud 42. The flank 34*a* accelerates the adjacent plug 21*a* to insure that the speed of sidewise movement of the plug 21*a* is increased to match the speed of the respective disk 29*a*.

The plug 21*b* of a group at the transfer station 38 travels further in the respective channel 46 and enters the oncoming flute 31*b* of the disk 29*b* to be thereupon entrained by the respective steep flank 34*b* in the direction indicated by arrow 28. The last plug 21*c* of a group at the transfer station 38 descends onto the gradually sloping leading flank 33*c* of the oncoming flute 31*c* in the periphery of the disk 29*c* and rolls along such leading flank toward the deepmost portion of the respective flute 31*c*. At such time, the plug 21*c* descends to a position at a level below the edge face 43 of the respective shroud 42 and advances along the concave inner surface of the shroud 42 toward the transfer station 52.

It will be noted that in a group of three coaxial filter plugs 21*a*, 21*b*, 21*c* which reach the station 38, only the filter plug 21*b* automatically descends into the deepmost portion of the respective flute 31*b*. The plug 21*a* is engaged and accelerated before it reaches the deepmost portion of the respective flute 31*a*, and the plug 21*c* is retained in the respective channel 46 for a longer period of time so as to enter the respective flute 31*c* behind the plugs 21*a*, 21*b*. This insures that the plugs 21*a*, 21*b*, 21*c* which were originally in axial alignment with each other are staggered, as considered in the circumferential direction of the conveyor 27. The plugs 21*a*, 21*b*, 21*c* which are received in the flutes 31*a*, 31*b*, 31*c* are held therein by the respective suction ports 47 during travel along the groove 49 of the valve plate 51. Such plugs reach the transfer station 52 and are introduced into successive flutes 53*a* of the shuffling conveyor 53 so that each flute of the conveyor 53 receives only one filter plug of double unit length. The manner in which the filter plugs are thereupon further manipulated and assembled with plain cigarettes of unit length to form therewith filter cigarettes of double unit length forms no part of the present invention.

The filter plugs in the flutes of disks 29*a*, 29*b*, 29*c* are preferably held by suction with such a force that a satisfactory plug is properly transferred to the station 52. However, if a plug has been damaged, partially destroyed or broken up during transfer at the station 38, suction in the port or ports 47 is insufficient to properly retain defective plugs so that the damaged or destroyed plugs are permitted to leave the respective flutes 31 under the action of centrifugal force and/or gravity to be propelled into an intercepting receptacle, not shown. For example, each of the disks 29*a*, 29*b*, 29*c* can be provided with two or three suction ports 47 for each of the flutes 31*a*, 31*b*, 31*c*. If a filter plug has been cut in half during transfer at the station 38, the filter plug portion which enters the respective flute 31 is attracted by fewer than the maximum number of suction ports 47 which is insufficient to prevent the ejection of such damaged filter plugs under the action of gravity and/or centrifugal force.

An important advantage of the improved manipulating apparatus is the simplicity of the staggering conveyor 27. As pointed out before, this conveyor can be assembled of three identically configurated disk-shaped portions or sections which need not rotate relative to each other and which need not be eccentric relative to each other. As shown, the disks 29*a*–29*c* of the conveyor 27 are coaxial with each other and rotate as a unit in the direction indicated by arrow 28. The staggering of filter plugs which form successive groups reaching the transfer station 38 is effected in part by the edge faces 39 of the shrouds 22 and in part by the flanks of surfaces surrounding the flutes of the disks 29*a*, 29*b*, 29*c*. The shrouds 22, 42 and disks 29*a*, 29*b*, 29*c* can be produced at a fraction of the cost of conventional staggering conveyors wherein several ring- or disk-shaped sections rotate relative to each other and are mounted for rotation about parallel axes.

The simplicity of the staggering conveyor 27 is also attributable to the fact that the conveyor 27 is spaced apart from the conveyor 4, i.e., that the pitch circles 36, 37 of these conveyors do not intersect each other. This renders it possible to construct or assemble the conveyor 27 in such a way that the pitch circle of the disk 29*a* is identical and concentric with the pitch circle of the disk 29*b* and/or 29*c*. The feature that the disks 29*a*–29*c* rotate as a unit also contributes to simplicity, ruggedness and low cost of the staggering conveyor. The simplicity of the staggering conveyor is further enhanced by the fact that the means for introducing one or more filter plugs of each group into the flutes of the respective disks may form part of such disks, i.e., of the staggering conveyor. This is particularly advantageous when the shrouds 22 and/or 42 extend substantially tangentially of the conveyor 27 at the transfer station 38.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. In an apparatus for manipulating filter rod sections or analogous rod-shaped articles, a combination comprising a first conveyor having a plurality of first receiving means each arranged to transport sideways a group of *n* coaxial articles along a first substantially circular path having a portion extending along a transfer station, said conveyor having a first pitch circle; a second conveyor having *n* annuli of second receiving means each arranged to receive and to transport sideways a single article along a second substantially circular path having a portion extending along said transfer station, said second conveyor having a second pitch circle and the distance between the centers of said pitch circles exceeding the combined length of te radii of said first and second pitch circles, the second receiving means of said annuli being staggered with respect to each other, as considered in the circumferential direction of said second conveyor; means for moving said first conveyor in a first direction; means for moving all of said annuli at the same speed in a second direction counter to said first direction so that the angular positions of said second receiving means with respect to each other remain unchanged; guide means defining at said transfer station a channel extending between said portions of said first and second paths; means for directing groups of articles from successive first receiving means in said portion of said first path into said channel wherein the articles of a group move sideways in a direction from said portion of said first path toward said portion of said second path; and means for transferring each article of a group in said channel into a second receiving means of a different annulus at timely spaced intervals so that each article of a group in said channel is located in a different portion of said channel when engaged by said transferring means.

2. A combination as defined in claim 1, wherein said guide means comprises a portion adjacent to said first path upstream of said transfer station and arranged to retain said groups of articles in the respective first receiving means.

3. A combination as defined in claim 1, wherein said means comprises a portion adjacent to said second path downstream of said transfer station and arranged to retain said articles in the respective second receiving means.

4. A combination as defined in claim 1, wherein said first pitch circle intersects each of said first receiving means and said second pitch circle intersects the second receiving means of at least one of said annuli.

5. A combination as defined in claim 1, wherein said second conveyor comprises *n* coaxial disk-shaped sections.

6. A combination as defined in claim 1, wherein said guide means comprises at least one shroud adjacent to said second path downstream of said transfer station and arranged to retain the articles in the second retaining means of said annuli, said means for directing groups of articles from successive first receiving means into said channel being rigid with said shroud.

7. A combination as defined in claim 6, wherein said means for directing extends across said first pitch circle.

8. A combination as defined in claim 1, wherein at least a portion of said transferring means forms part of said second conveyor.

9. A combination as defined in claim 8, wherein said second conveyor has surfaces bounding said second receiving means and wherein portions of said surfaces constitute said portion of said transferring means.

10. A combination as defined in claim 1, wherein said guide means comprises first and second guide members respectively adjacent to said first and second paths and respectively located upstream and downstream of said transfer station for respectively retaining articles in said first and second receiving means, said channel being disposed between said guide members.

11. A combination as defined in claim 10, wherein said means for directing forms part of said second guide member and said transferring means includes portions of said first guide member and said second conveyor.

12. A combination as defined in claim 1, wherein at least one of said conveyors comprises pneumatic retaining means for holding the articles in the respective receiving means.

13. A combination as defined in claim 1, wherein said first conveyor comprises a rotary fluted drum and said first receiving means are axially parallel flutes provided in the periphery of said drum.

14. A combination as defined in claim 13, further comprising a magazine arranged to store a supply of rod-shaped articles of *n*-times length and having an outlet, said drum comprising a portion adjacent to said outlet so that the flutes which travel along said outlet receive from said supply articles of *n*-times length, and further comprising severing means adjacent to said first path between said outlet and said transfer station and arranged to subdivide successive articles of *n*-times length into *n* discrete coaxial articles.

15. A combination as defined in claim 14, wherein said outlet has an end adjacent to said severing means and further comprising refuser means adjacent to said end of said outlet and arranged to prevent escape from said magazine of articles other than those leaving the magazine in said first receiving means.

16. A combination as defined in claim 15, wherein said refuser means comprises a roller and means for rotating said roller counter to the direction of rotation of said drum.

* * * * *